US008429925B2

(12) United States Patent
Marx

(10) Patent No.: US 8,429,925 B2
(45) Date of Patent: Apr. 30, 2013

(54) DEVICE FOR COOLING HOT LIQUID FOOD ITEMS TO DRINKING TEMPERATURE

(76) Inventor: Dieter Marx, Wertingen (DE)

( * ) Notice: Subject to any disclaimer, the term of this patent is extended or adjusted under 35 U.S.C. 154(b) by 0 days.

(21) Appl. No.: 13/409,860

(22) Filed: Mar. 1, 2012

(65) Prior Publication Data

US 2012/0199338 A1 Aug. 9, 2012

Related U.S. Application Data

(62) Division of application No. 11/908,475, filed as application No. PCT/EP2006/060628 on Mar. 10, 2006, now abandoned.

(30) Foreign Application Priority Data

Mar. 12, 2005 (DE) ..... 20 2005 044 008 U
Apr. 21, 2005 (DE) ..... 20 2005 006 424 U

(51) Int. Cl.

| | |
|---|---|
| ***F28D 17/00*** | (2006.01) |
| ***F28F 7/00*** | (2006.01) |
| ***A47J 39/00*** | (2006.01) |
| ***B67D 7/80*** | (2010.01) |
| ***B65B 3/04*** | (2006.01) |
| ***B65B 3/00*** | (2006.01) |

(52) U.S. Cl.
USPC ..... 62/389; 165/10; 165/80.5; 220/592.01; 222/146.5; 222/146.6; 141/319; 141/320; 141/321; 141/82; 141/364; 141/365; 141/366; 62/293; 62/434; 62/439; 62/437.3; 62/457.8; 62/63; 62/64

(58) Field of Classification Search ..... 165/10, 165/80.5; 220/592.01; 222/146.5, 146.6; 141/319, 320, 321, 82, 363–366; 62/389, 62/293, 434, 439, 437.3, 457.8, 63–64
See application file for complete search history.

(56) References Cited

U.S. PATENT DOCUMENTS

| | | | | |
|---|---|---|---|---|
| 991,568 A | | 5/1911 | Walter | |
| 2,909,362 A | * | 10/1959 | Scanlon | 165/73 |
| 4,338,795 A | | 7/1982 | House, Jr. | |

(Continued)

FOREIGN PATENT DOCUMENTS

| | | |
|---|---|---|
| GB | 2250576 | 6/1991 |
| GB | 2222578 | 9/2007 |

(Continued)

OTHER PUBLICATIONS

Written report from EPO counterpart application dated Oct. 11, 2010. Machine English translation WO2004070294; Marx Aug. 19, 2004; p. 1-7.

*Primary Examiner* — Frantz Jules
*Assistant Examiner* — Erik Mendoza-Wilkenfel
(74) *Attorney, Agent, or Firm* — Margaret Polson; Oppedahl Patent Law Firm

(57) ABSTRACT

A device 1 for cooling hot liquid food items to drinking temperature comprising a cooling system 2 containing a coolant 19 with a cooling line 13 and an inflow for the hot liquid and an outflow for the cooled liquid. The device includes at least one filling vessel 3 connectable with its opening 5 to the end side of the cooling system containing the inflow to the cooling system. For connecting the filling vessel to the cooling system, each of the two parts includes complementarily cooperating connection elements 9, such that for the process of cooling a virtual unit can be formed, and as a function of the defined quantity of liquid flowing from the filling vessel into the inflow of the cooling system, and the temperature and of the quantity of the coolant, the liquid flows from the outflow of the cooling system at a temperature specified within narrow limits.

6 Claims, 3 Drawing Sheets

U.S. PATENT DOCUMENTS

| | | | | |
|---|---|---|---|---|
| 4,478,346 | A | 10/1984 | Spong | |
| 4,599,872 | A * | 7/1986 | Rist | 62/399 |
| 5,586,647 | A | 12/1996 | Barta et al. | |
| 2008/0302822 | A1 * | 12/2008 | Tetreault et al. | 222/146.6 |

FOREIGN PATENT DOCUMENTS

| | | |
|---|---|---|
| JP | 2003 095398 | 4/2003 |
| WO | 2004070294 | 8/2004 |

* cited by examiner

DEVICE FOR COOLING HOT LIQUID FOOD ITEMS TO DRINKING TEMPERATURE

CROSS REFERENCE APPLICATIONS

This application is a divisional of Ser. No. 11/908,475 filed 2008, Apr. 1, which was the U.S. National Stage application of PCT/EP2006/060628, which is hereby incorporated by reference, which claimed priority to German application no. 20 2005 006 424.6 filed Apr. 21, 2005 and German application 20 2005 004 008.8 filed Mar. 12, 2005.

BACKGROUND

The invention relates to a device for cooling hot liquid food items such as water to drinking temperature. The device comprises a cooling system containing a coolant and a cooling line carried through the coolant having an inflow for letting in the hot liquid and an outflow for the cooled liquid.

These types of cooling devices are employed for preparing meals for a baby or an infant, among other possible uses. When preparing such a meal, boiled hot water is conducted through the cooling device in order to cool the hot water to drinking temperature faster than cooling the water in the ambient air. WO 2004/070294 A1 discloses a prior art cooling device for this purpose. The cooling device described in this document comprises at its core a cooling system with a coiled cooling line immersed in a coolant. The cooling line has an upper connection fitting attached to an inflow and a lower connection fitting attached to an outflow. The inflow opens out at the upper side of the cooling system, the outflow at the lower side. A filling aid can be set onto the inflow side of the cooling system. The filling aid is a funnel-shaped object with a lower outflow for introducing the hot liquid into the inflow of the cooling line.

In one embodiment of WO 2004/070294 A1, the filling aid also functions as a measuring cup for measuring the quantity of liquid to be cooled. However, in order to be able to supply a defined quantity of hot liquid to the cooling system and for the hot liquid poured into the filling aid not to flow into the cooling line before the completion of the measuring process, it is necessary to have a valve which is closed during the process of filling and measuring the hot liquid in the filling aid, either at the outflow end or the cooling system at the inflow end. Otherwise the measuring process is falsified due to the hot liquid flowing out of the cooling line. Such falsification can lead to overfilling of a collection vessel designed for a specific quantity of liquid. Also, it is not ensured that the liquid flowing out of the cooling system is not over cooled, so that the prepared meal must be slightly warmed up again.

The underside of the prior art cooling system includes connection means to attach a collection vessel, for example a baby bottle. The cooled liquid food item flows into this vessel, delivered by the cooling line. The desired meal is subsequently prepared and administered to the baby or infant with the water at drinking temperature.

Other disadvantages the prior art cooling device include the difficulty handling and the difficulty of cooling a predefined quantity of liquid unless additional valves are utilized. With devices which come into contact with food it is also desirable to make the parts coming into contact with the food item easy to clean. Additionally, in the prior art cooling device when filling the hot liquid into the filling aid the remaining components of the cooling device must be held firmly to avoid tipping over the cooling device and having the hot water spill, unless the components are otherwise secured in place.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

The present device is a cooling device which comprises a filling vessel with defined fill volume that connects at its opening to the inflow side of the cooling system and is closed by the connection to the cooling system. Both the filling vessel and cooling systems include complementarily cooperating connection elements, such that a virtual unit can be formed. Furthermore, when a defined quantity of liquid flows out of the filling vessel into the inflow of the cooling system which is at a defined temperature and has defined quantity of the coolant, the liquid flows out of the outflow of the cooling system at a temperature within narrow limits.

The present cooling device includes at least one filling vessels with defined fill volume. Each of these filling vessels is connectable with its opening to the inflow end of the cooling system. One possible connection means is by cooperating threaded sections on both the filling vessel and the cooling system. The filling vessels can be connected with the cooling system to form a virtual unit. The filling vessels are closed by the connection to the cooling system such that liquid in the filling vessel can only flow out through the cooling line of the cooling system. The filling vessels therefore advantageously comprise only one opening for filling the hot food item to be cooled and also for letting the same flow out. The filling vessels are can be conceptualized as a mug or a bottle. In one embodiment the filling vessels include thermal insulation. The insulation facilitates the handling of the filling vessels and the hot liquid in the filling vessel maintains a hot temperature level for some time. This allows the liquid entering the cooling line to have a more defined temperature.

The filling vessel has a defined fill volume which can be indicated through a marking in or on the filling vessel. In one embodiment the filling vessel is designed such that when it is filled with the specified quantity of liquid it is almost full to the brim. The handling of a filling vessel filled with hot liquid is not a problem since the filling vessel does not need to be moved. Rather, the cooling system can be connected with the filling vessel so that the filling vessel is closed off to prevent spilling. Basically, the cooling system acts as a lid for the filling vessel.

At the beginning of the cooling process the filling vessel with the hot liquid to be cooled is at the bottom and is closed by the inflow end of the cooling system. By inverting the cooling device such that the cooling system is at the bottom and the filling vessel has its opening above the inflow of the cooling device the liquid flows into the cooling device and the cooling process is initiated. The hot liquid located in the filling vessel flows into the inflow of the cooling system, passes through the cooling line, wherein a defined quantity of heat is withdrawn from the hot liquid, and subsequently flows out of the outflow of the cooling system. The coolant contained in the cooling system has previously been brought to a defined temperature by placing it in a refrigerator or freezer at refrigerator temperature for a certain length of time, for example.

When the cooling device is used as disclosed a defined quantity of liquid is introduced into the cooling line from the filling vessel and based on the knowledge of the temperature and quantity of the coolant, and of the flow rate of the liquid to be cooled, a defined quantity of heat is withdrawn. This means that the subsequently cooled liquid flows out at the outflow end at a temperature predefined within narrow limits.

As a virtual unit is formed between the filling vessel and the cooling system, during the process of inversion the air present in the filling vessel rises through the hot liquid toward the bottom of the filling vessel and in doing so is heated and expands. Therefore, pressure is generated in the filling vessel during the inflowing of the hot liquid into the cooling system and correspondingly during the flow of the liquid through the cooling system. This pressure promotes the liquid to be cooled flowing through the cooling line and contributes to the flow of the quantity of liquid taking place at a defined flow rate through the cooling line. The pressure building up in the filling vessel primarily promoting a defined flow of the liquid to be cooled when the filling vessel has been partially or largely emptied.

A venting opening is provided to introduce air into the emptying filling vessel during the process of cooling. The venting opening is located at the interface between the filling vessel and the cooling system, such that the air supplied into the filling vessel is heated and expands during its percolation through the hot liquid in the filling vessel and contributes to a defined pressure buildup within the filling vessel during its emptying.

In this cooling device there is almost no risk that hot liquid can spilled, since filling vessel is combined with the cooling system to form a virtual unit for the process of cooling. The device can be readily handled once the virtual unit of the filling vessel and the cooling system is formed. For example, the cooling device with its outflow facing down can be placed onto a drinking vessel so the liquid flowing out of the outflow goes into the drinking vessel. Such a utilization of the cooling device can be used with tea to shorten the cooling time until the tea has reached its drinking temperature.

In further embodiment the cooling system also includes at the outflow end a connection means for the connection of a collection vessel to collect the cooled liquid. This connection means can be an inner thread section which can be connected to a baby bottle with an outer threading for example. In such an embodiment a virtual unit of filling vessel, cooling system and collection vessel is formed before the cooling process is initiated by turning over or inverting the cooling device. Neither hot nor cooled liquid can leak from this cooling device.

A stand for holding the virtual unit of the filling vessel, cooling system and, optionally, the collection vessel can be used with the cooling device. The cooling device can be securely held in place by this stand. In a further development of the stand, the holder can be swivellable, so that the holder rests on a base and the cooling device can be swivelled on it 180 degrees to be able to invert this cooling device appropriately for the hot water to flow in through the cooling system into the collection vessel after filling the hot water into the filling vessel and joining the cooling device. The cooling device can be connected to the holder with a cable disposed on the holder in which the cooling system can be suspended.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
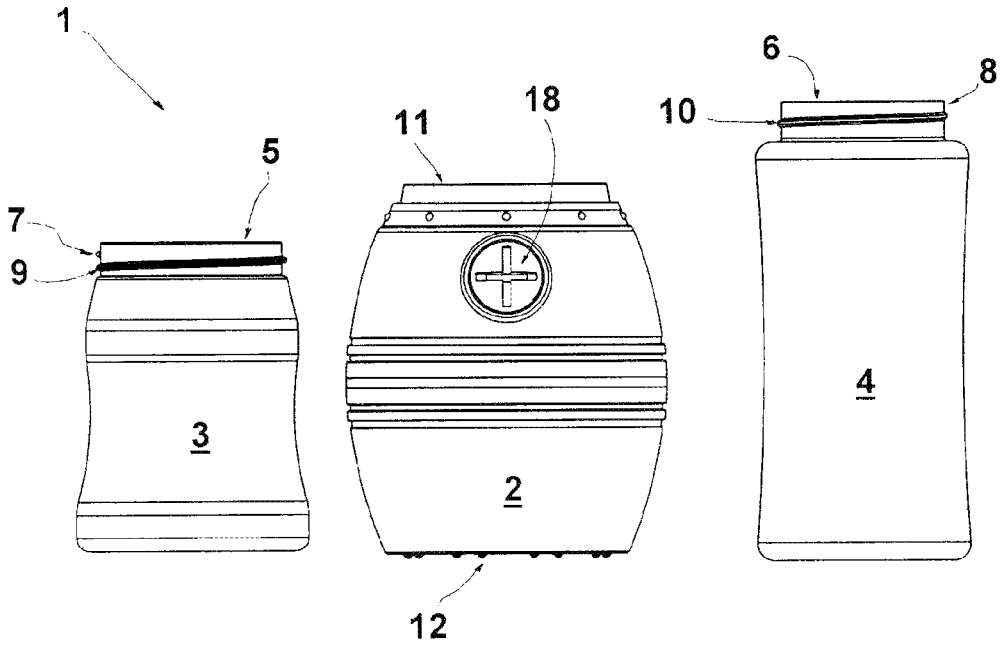
FIG. 1 is a side view of three elements of a cooling system.

Referring first to FIG. 1, a cooling device 1 comprises a cooling system 2, a filling vessel 3 and a collection vessel 4. In the depicted embodiment, the filling vessel 3 and the collection vessel 4 are each developed in the manner of bottles and include a single opening 5 and 6, respectively. The openings 5, 6 are encompassed by a neck section 7 and 8, respectively, onto which an outer thread section 9 and 10, respectively, is formed. The outer thread section 9, 10 connects the filling vessel 3 or the collection vessel 4 to the cooling system 2. For this purpose the cooling system 2 includes complementary inner thread sections, which are disposed for the connection of the filling vessel 3 to its inflow end 11 and of the collection vessel 4 to its outflow end 12. Each of the two thread sections 9, 10 has a different diameter to avoid confusing the connections. This ensures that the filling vessel 3 can only be connected to the inflow end 11 and the collection vessel 4 only to the outflow end 12 of the cooling system 2.

Figure 2:
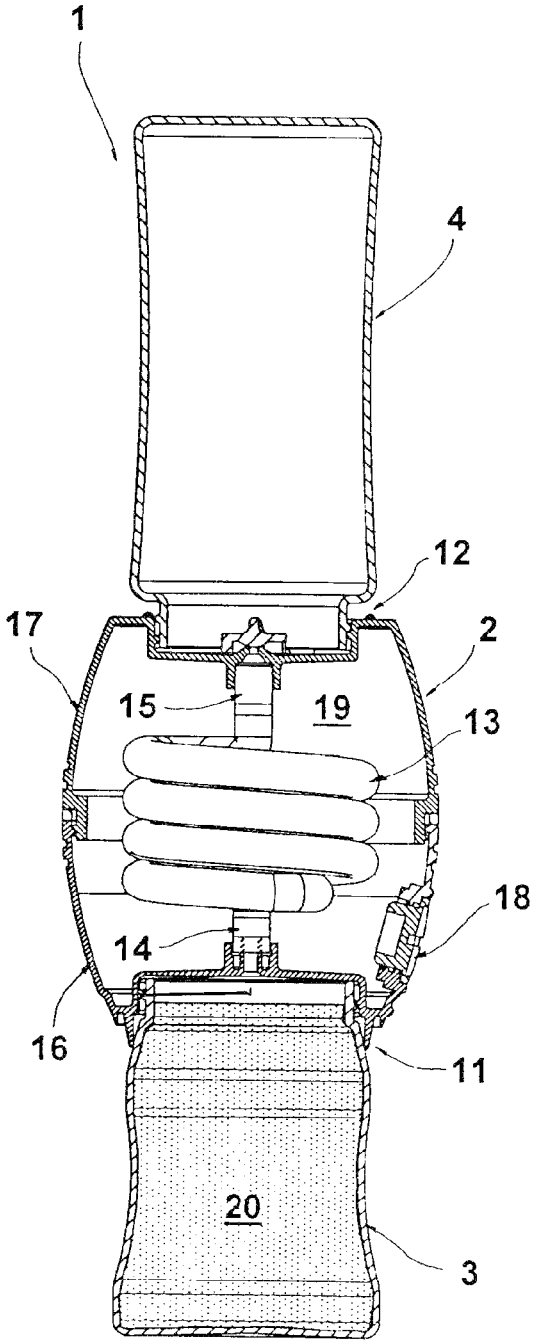
FIG. 2 is a longitudinal section view of the cooling device formed of the three elements of FIG. 1 before the cooling.

The joined cooling device 1 is shown in FIG. 2. The connections of the collection vessel 4 to the outflow end 12 of the cooling system 2 and the connection of the filling vessel 3 to the inflow end 11 of the cooling system 2 are visible. The inflow end 11 and the outflow end 12 each include complementary inner thread sections to connect the filling vessel 3 and the collection vessel 4. The cooling system 2 includes a coiled cooling line 13, whose connection 14, the lower one in FIG. 2, is conducted to the inflow end 11 and whose upper connection 15 is conducted to the outflow end 12 of the cooling system 2. The bottom of the inflow end 11 and of the outflow end 12 each includes an opening for allowing liquid to flow into or out of the cooling line 13.

In the depicted embodiment example the cooling system 2 is formed of two half shells 16, 17, which are sealingly connected with one another. The lower half shell 16 comprises a closure 18, through which a coolant can be introduced into the cooling system 2. The cooling system 2 is filled with a coolant 19 (not marked by hatching). The coolant 19 can be water or an alcohol or an alcohol mixture, for example. The coolant 19 is encapsulated within the cooling system 2 and can only flow out it when the closure 18 is opened. A defined quantity of coolant is disposed within the cooling system 2 such that the coiled section of the cooling line 13 is immersed therein.

The collection vessel 3 has a defined fill volume, and in FIG. 2 is filled with boiled hot water 20 nearly to the brim. A small quantity of air is enclosed between the water level and the bottom of the inflow end 11 of the cooling system 2. The hot water 20 has been introduced into the filling vessel 3 before its opening 5 had been closed by screwing on the cooling system 2 with its inflow end 11. The cooling system 2 had been stored in a refrigerator before it is screwed onto the filling vessel 3 for the intended cooling process. The coolant 19 contained in the cooling system 2 therefore has a refrigerator temperature of approximately 4 to 6° C.

Figure 3:
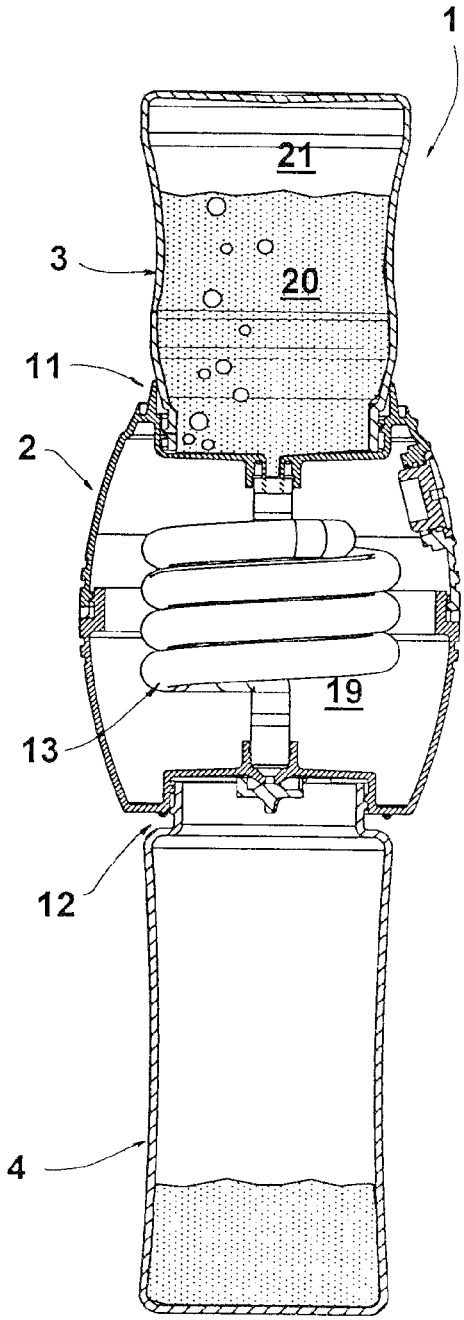
FIG. 3 is a longitudinal section view the cooling device of FIG. 2 during the process of cooling.

As depicted in FIG. 3, to cool the hot water disposed in the filling vessel 3, the cooling device 1 is inverted by 180° such that subsequently the collection vessel 4 is located at the bottom and is standing on its bottom. By inverting the cooling device 1 into its cooling position shown in FIG. 3, the hot water 20 disposed in the filling vessel 3 flows into the cooling line 13. During the passage through the cooling line 13 heat is withdrawn from the passing hot water, such that the coolant 19 disposed in the cooling system 2 is heated. Subsequently cooled water flows out at the outflow end 12 of the cooling system 2 and into the collection vessel 4, which can be a baby bottle. The air originally present in the filling vessel 3 percolates through the hot water 20 during this process, as is indicated in FIG. 3 by the bubbles therein. The air expands and builds up a pressure in the region 21 of the filling vessel 3, which is now the upper one, which promotes the emptying process. A venting opening through which ambient air enters into the filling vessel 3 during its emptying is additionally disposed at the interface between the cooling system 2 and the filling vessel 3.

The ambient air is also conducted through the hot water 20 and expands and promotes the pressure buildup in the filling vessel. This additional pressure build up promotes the emptying process, in particular when the filling vessel 3 is partially empty. The pressure buildup within the filling vessel 3 also promotes the cooling process proceeding under smooth conditions as the hot water 20 flows out, in particular with respect to the rate of the hot water 20 when passing through the cooling line 13. Consequently due to the knowledge of the remaining factors affecting the cooling process, the temperature of the water flowing out at the outflow end can be predicted within narrow limits. The cooling process is consequently defined and reproducible with a relatively constant delivery temperature. This presupposes that after each cooling process the coolant 19 contained in the cooling system is again brought to its starting temperature, advantageously to refrigerator temperature. For this purpose the cooling system 2 is placed for some time into the refrigerator.

In one embodiment the clearance-passage width of the venting opening at the interface between the filling vessel 3 and the cooling system 2 is dimensioned such that air can enter, but water cannot leak out of it. The air present in the filling vessel 3 presses the hot liquid into the cooling line 13 of the cooling system 2 due to its expansion after turning the configuration from the position shown in FIG. 2 into the position shown in FIG. 3. This expansion in turn causes ambient air to be siphoned in which maintains the pressure within the filling vessel 3 when percolating through the hot liquid to be cooled, due to the heating and the expansion of the ambient air.

Figure 4:
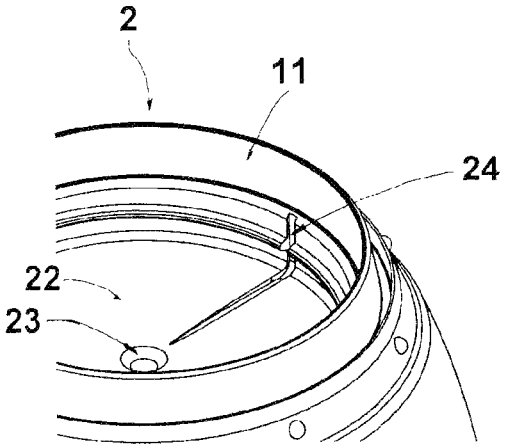
FIG. 4 is top a perspective detail view of the inflow end of the cooling system.

The venting opening, previously described at the interface between the cooling system 2 and the filling vessel 3, is shown in perspective detail view in FIG. 4. FIG. 4 shows the inflow end 11 of the cooling system 2 with its bottom 22 and its inlet opening 23. The bottom 22 is formed toward the inlet opening 23 in the shape of a funnel. A notch 24 pierces through the inner thread section and extending into the bottom 22. This notch 24 serves as a path for the ambient air to enter into a filling vessel 3 connected to the inflow end 11 of the cooling system 2 when the vessel empties.

Figure 5:
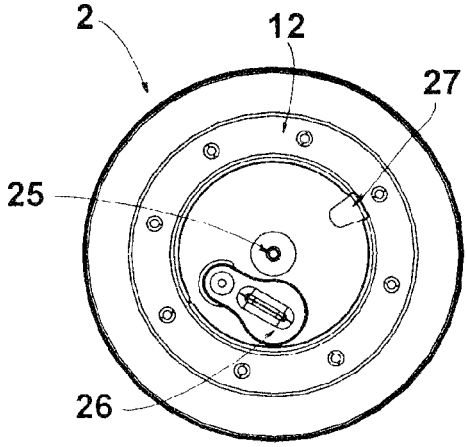
FIG. 5 is a top plan view of the outflow end of the cooling system.

FIG. 5 shows the outflow end 12 of the cooling system 2 with its outlet opening 25, which can be closed by a slider 26. The slider 26 can be slid over the outlet opening 25 when the cooling system 2 is stored in a refrigerator, oriented with the outflow end 12 downwardly, for cooling the coolant 19 contained therein. At the interface between the cooling system 2 and the collection vessel 4, a venting opening 27 is provided to allow air which has been displaced through the entry of the cooled liquid into the collection vessel 4 to escape.

Instead of providing the notch in the inner edge of the inflow end 11 of cooling system 2, as shown in FIG. 4, this notch can also be located on the outer edge of the neck section 7 of the filling vessel 3.

Figure 6:
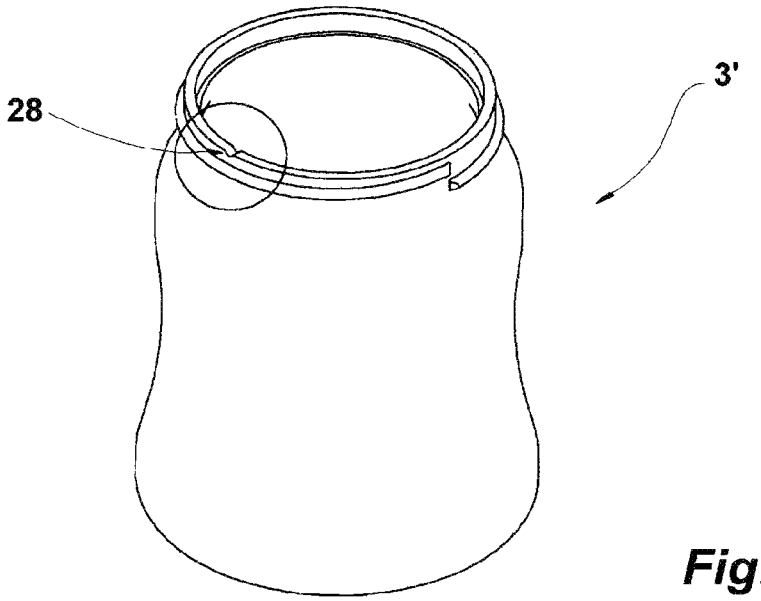
FIG. 6 is a perspective view of a filling vessel according to a further embodiment of a cooling device.

FIG. 6 shows a filling vessel 3' for a cooling device in which a venting notch 28 is introduced into the upper front-end closure of the filling vessel 3'. This filling vessel is utilized in connection with a cooling system which does not include a notch 24, but is otherwise structured like the previously described cooling system 2.

Figure 7:
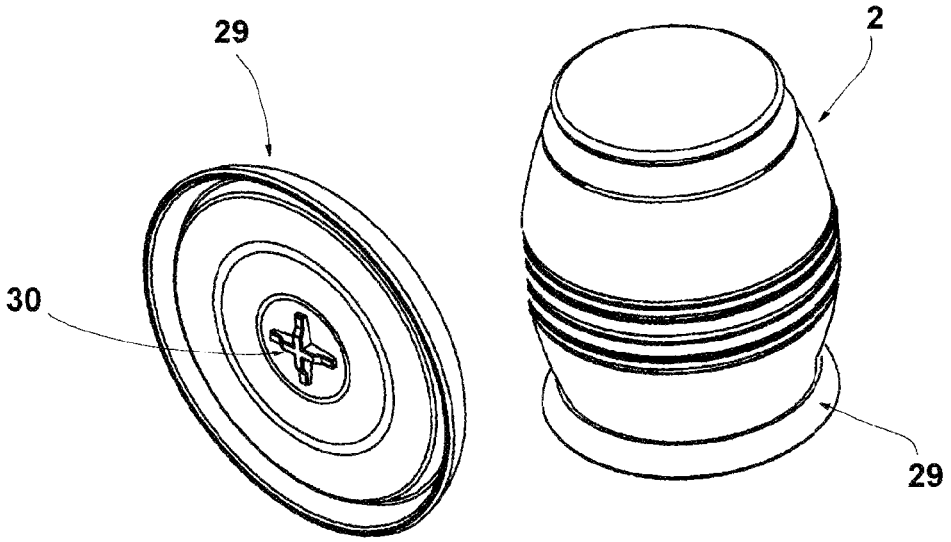
FIG. 7 is a perspective view of a pedestal associated with the cooling device of FIGS. 1 to 5 with cooling system (right diagram) set thereinto as well as a perspective view onto the underside (left diagram).

FIG. 7 shows a pedestal 29 which is used to increase the stability against overturning of the cooling device 1 in the position depicted in FIGS. 2 and 3. The pedestal 29 can also serve for inserting the cooling system 2, as is shown in FIG. 7 in its right diagram. The pedestal 29 includes for this purpose an upper-side reception, into which can be set the lowest section of the filling vessel 3 (at a position of the cooling device 1 according to FIG. 2), of the collection vessel 4 (at a position of the cooling device 1 according to FIG. 3) or the cooling system 2 (as shown in FIG. 7). In a further development this pedestal 29 includes at the underside a cross-shaped member 30, whose configuration is complementary to the cross-slit-shaped recess of the closure 18 of the cooling system 2. Pedestal 29 serves consequently also as a tool for opening and closing the closure 18 of the cooling system 2.

LIST OF REFERENCE NUMBERS

1 Cooling device
2 Cooling system
3, 3' Filling vessel
4 Collection vessel
5 Opening
6 Opening
7 Neck section
8 Neck section
9 Outer thread section
10 Outer thread section
11 Inflow end
12 Outflow end
13 Cooling line
14 Connection
15 Connection
16 Half shell
17 Half shell

18 Closure
19 Coolant
20 Water
21 Region
22 Bottom
23 Inlet opening
24 Notch
25 Outlet opening
26 Slider
27 Venting opening
28 Notch
29 Pedestal
30 Forming While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true sprit and scope. Each apparatus embodiment described herein has numerous equivalents.

The invention claimed is:

1. Device for cooling hot water to a drinking temperature for preparing a meal for a baby or small child comprising:

a cooling system containing a coolant, said coolant being water, with a cooling line extending through the coolant and having an inflow on an inflow side for letting in hot water and an outflow on an outflow side for cooled water;

wherein the cooling system has a closure through which the coolant is introduced into the cooling system;

a least one filling vessel with defined fill volume for receiving the water to be cooled and an opening;

the filling vessel being connectable at the opening to the inflow side of the cooling system, the opening of the filling vessel being closed by the connection to the cooling system;

the filling vessel opening and the inflow side of cooling system each further comprises complementarily cooperating connection elements such that the filling vessel and the cooling system form a virtual unit;

a venting opening, said venting being a notch piercing the connection elements of the inflow end of the cooling system, is disposed at the interface between the cooling system and the filling vessel for introducing ambient air into the emptying filling vessel such that after inverting the virtual unit by 180° for initiating the cooling process the introduced air becomes heated during the percolation through the hot water;

wherein as a function of the defined quantity of hot water flowing from the filling vessel into the inflow of the cooling system and of the temperature and of the quantity of coolant contained in the cooling system the hot water flows from the outflow of the cooling system at a temperature specified within narrow limits;

at least one collection vessel for collecting the cooled water, said collection vessel being connectable to the outlaw end of the cooling system and wherein at the outflow end of the cooling system further comprises connection means for connecting the collection vessel;

wherein the cooling system further comprises an inner thread section at its inflow end and the at least one filling vessel comprises a corresponding outer thread section;

a venting opening disposed at the interface between the cooling system and the collection vessel.

2. The cooling device as claimed in claim 1 wherein the particular connection means on the inflow end and outflow end of the cooling system have different diameters.

3. The cooling device of claim 2 further comprising a venting opening disposed at the interface between the cooling system and the collection vessel.

4. The cooling device of claim 1 wherein the at least one filling vessel is thermally insulated.

5. The cooling device of claim 1 further comprising a standing foot.

6. The cooling device of claim 5, wherein the underside of the standing foot has a member intended for use as a tool.

* * * * *